US009212413B2

(12) United States Patent
Wang et al.

(10) Patent No.: US 9,212,413 B2
(45) Date of Patent: Dec. 15, 2015

(54) METAL MATRIX CERAMIC COMPOSITE AND MANUFACTURING METHOD AND APPLICATION THEREOF

(71) Applicant: CHINA WEAPON SCIENCE ACADEMY NINGBO BRANCH, Ningbo (CN)

(72) Inventors: Jinhua Wang, Ningbo (CN); Bo Yang, Ningbo (CN); Zhiyuan Xing, Ningbo (CN); Xiurong Zhu, Ningbo (CN); Shunqi Zheng, Ningbo (CN); Ying Wang, Ningbo (CN); Juan Lv, Ningbo (CN); Zhaohui Gong, Ningbo (CN); Liqun Hou, Ningbo (CN)

(73) Assignee: CHINA WEAPON SCIENCE ACADEMY NINGBO BRANCH, Ningbo (CN)

( * ) Notice: Subject to any disclaimer, the term of this patent is extended or adjusted under 35 U.S.C. 154(b) by 63 days.

(21) Appl. No.: 13/852,361

(22) Filed: Mar. 28, 2013

(65) Prior Publication Data

US 2014/0087202 A1 Mar. 27, 2014

(30) Foreign Application Priority Data

Sep. 24, 2012 (CN) ..... 2012 1 0357694

(51) Int. Cl.

| | |
|---|---|
| ***B22D 19/14*** | (2006.01) |
| ***C22C 49/14*** | (2006.01) |
| ***B22D 19/00*** | (2006.01) |
| ***C22C 29/06*** | (2006.01) |
| ***C22C 29/12*** | (2006.01) |
| ***C22C 29/14*** | (2006.01) |
| ***C22C 29/16*** | (2006.01) |
| ***E05G 1/024*** | (2006.01) |
| ***F41H 5/04*** | (2006.01) |
| *C22C 32/00* | (2006.01) |
| *C22C 1/10* | (2006.01) |

(52) U.S. Cl.

CPC ..... *C22C 49/14* (2013.01); *B22D 19/00* (2013.01); *B22D 19/14* (2013.01); *C22C 29/062* (2013.01); *C22C 29/065* (2013.01); *C22C 29/12* (2013.01); *C22C 29/14* (2013.01); *C22C 29/16* (2013.01); *E05G 1/024* (2013.01); *F41H 5/0421* (2013.01); *F41H 5/0492* (2013.01); *C22C 32/00* (2013.01); *C22C 32/0047* (2013.01); *C22C 2001/1073* (2013.01)

(58) Field of Classification Search

CPC ..... B22D 19/14; B22D 19/00
USPC ..... 164/97
See application file for complete search history.

(56) References Cited

U.S. PATENT DOCUMENTS

| | | | | |
|---|---|---|---|---|
| 4,947,924 | A * | 8/1990 | Morita et al. | B22D 19/14 164/103 |
| 5,361,678 | A * | 11/1994 | Roopchand et al. | 89/36.02 |
| 5,763,813 | A * | 6/1998 | Cohen et al. | 89/36.02 |
| 7,833,627 | B1 * | 11/2010 | Ferrando | 428/416 |
| 2003/0161750 | A1 * | 8/2003 | Moxson et al. | 419/2 |
| 2012/0266745 | A1 * | 10/2012 | Warren | 89/36.02 |

* cited by examiner

*Primary Examiner* — Kevin P Kerns
(74) *Attorney, Agent, or Firm* — Wang Law Firm, Inc.; Li K. Wang; Stephen Hsu

(57) ABSTRACT

A metal matrix ceramic composite is completely formed by permeating at least part of a matrix metal into an array of ceramic granules by squeeze-casting, and the volume percentage of the ceramic granules may be adjusted within a range of 10%-80% of the metal matrix ceramic composite according to the usage requirements. The metal matrix ceramic composites not only retain high performance of anti-penetration, but also have the strong toughness of the metal; in addition, this composite has features of low density, resistance against ordinary mechanical cutting and flame cutting, and inhibition of crack propagation and the like. The composite has broad application prospects in the protection of such important security facilities as safes, automatic teller machines and vault gates.

10 Claims, 3 Drawing Sheets

METAL MATRIX CERAMIC COMPOSITE AND MANUFACTURING METHOD AND APPLICATION THEREOF

RELATE APPLICATIONS

The claims are benefit to Chinese Patent Application 201210357694.5, filed on Sep. 24, 2012. The specifications of both applications are incorporated here by this reference.

FIELD OF THE INVENTION

The invention relates to the technical field of protective materials, in particular to a metal matrix ceramic granule composite prepared by a casting and infiltration method. Said composite can be applied in important security fields, such as safes, automatic teller machines and vault gates.

DESCRIPTION OF THE PRIOR ART

With the development of national economy and the improvement of people's living standards, for the need of the public security, companies, banks and the like promote the fast development of the safe industry. Recent years, the safe industry has maintained a strong momentum of development. China has become a manufacturing center of the world's safe industry. With the diversification and internationalization of market demands, the competition in the safe industry becomes more and more fierce. Meanwhile, protection demands in such fields as automatic teller machines and vault gates are also urgent. It is badly in need of multifunctional protective materials with good performance in detonation resistance, shock resistance, crush resistance, heat insulation, water tightness, flame cutting resistance, radiation resistance and the like. By replacing ordinary steels with new-generation protective materials with good overall performance, the international competitiveness of industries such as safes, automatic teller machines and vault gates will be improved greatly.

With its excellent protective performance, light weight and inexpensive price, ceramics become a novel protective material and show better overall performance when compared with other materials. However, as ceramics are brittle, a series of damages, such as cracking, collapsing and crack propagation, may occur in the impacted area when ceramics are impacted by detonation waves and shots. Meanwhile, ceramics have to be adhesively connected because of the lack of welding property. Therefore, the popularization and application of ceramics are limited to some extent. According to this patent application, metal is used as the matrix in which ceramic granules are coated, thus achieving the tight restriction of ceramics and improving the overall protective performance of ceramics.

The metal matrix ceramic composite in the present patent application has not been reported in China and other countries, although protective materials related to the metal matrix ceramic composites have been introduced both at home and abroad. In China, jade ball/aluminum alloy composites are prepared by means of powder metallurgy in Nanjing University of Aeronautics and Astronautics. In addition, there are reports related to the preparation of ceramic ball composites by means of non-metal material bonding, mechanical connection, encapsulation and the like in China and other countries. Materials disclosed by U.S. Pat. No. 3,431,818 are laminated protective materials formed by adhering ball ceramics and plate ceramics together via organics. Materials disclosed by U.S. Pat. No. 7,694,621B1 are laminated protective materials formed by connecting ball ceramics and block ceramics or post ceramics together by mechanical connection, for example, riveting or bolting. Materials disclosed by U.S. Pat. No. 5,361,678 are protective materials formed by mold pressing technique of a layer of large ball ceramics after the ball ceramics are encapsulated by a graphite mold and cover plate with apertures, and said layer of large ball ceramics is formed with a transitional coating using adhesives and micron ceramic granules on its surface and is about 25.44 mm in diameter. Preparation of metal matrix ceramic composites by means of powder metallurgy is a complex process and leads to low metal strength and high production cost, which is disadvantageous to the large-scale popularization and application. But, for preparation of metal matrix ceramic composites by means of bonding, mechanical connection, encapsulation and the like, the restriction on ceramics from metal is insufficient in such structures, hence low overall performance of the material. Therefore, further improvement and design are required.

SUMMARY OF THE INVENTION

It is a first object of the present invention to provide a metal matrix ceramic composite that is convenient for manufacturing and rational in both process and structure.

It is a second object of the present invention to provide a method for manufacturing a metal matrix ceramic composite that is convenient for manufacturing and rational in process.

It is a third object of the present invention to provide an application of the metal matrix ceramic composite.

For achieving the first stated object, the metal matrix ceramic composite is completely formed by permeating at least part of a matrix metal into an array of ceramic granules by means of squeeze-casting.

Preferably, the matrix metal is selected from a group consisting of steel, aluminum alloy, titanium alloy, zinc alloy, copper alloy, and magnesium alloy.

Preferably, the ceramic granules comprise one or more of following granules: $Al_2O_3$ ceramic granules, $ZrO_2$ ceramic granules, $B_4C$ ceramic granules, SiC ceramic granules, $Si_3N_4$ ceramic granules, $TiB_2$ ceramic granules, and $Al_2O_3$+$ZrO_2$ ceramic granules; and isometric spherical granules transformed from the ceramic granules having a diameter between 1 mm and 15 mm.

Preferably, the ceramic granules are spheroids with a sphericity of above 0.7 or ellipsoids.

Preferably, the ceramic granules have a multilayer structure and a volume that is within a range of 10%-80% of the metal matrix ceramic composite.

Preferably, the ceramic granules are homogeneous ceramic granules or heterogeneous ceramic granules, and the ceramic granules with different granular diameters may be distributed randomly, in a gradient way, or according to a distribution function.

Preferably, the ceramic granules are orderly and hierarchically arrayed via metallic or non-metallic wire meshes according to application requirements.

Preferably, apertures of the wire meshes are smaller than diameter of isometric spherical granules transformed from the ceramic granules, and space between layers of the wire meshes is adjusted according to an entire thickness of the metal matrix ceramic composite and application requirements.

Preferably, the matrix metal has a surface layer with a first thickness and a mixed layer of the ceramic granules and the matrix metal has a second thickness, the first thickness and the second thickness may be adjusted according to an entire thickness of the metal matrix ceramic composite and application requirements.

Finally, the entire thickness of the metal matrix ceramic composite may be determined according to specific usage needs, generally preferably, three times larger than the diameter of the used ceramic granules.

For achieving the second object, A method for manufacturing a metal matrix ceramic composite comprises steps of: heating ceramic granules and maintaining a heating temperature of the ceramic granules between 400° C. and 1400° C. according to type of matrix metals and ceramics used; putting the ceramic granules into a cavity of a squeeze-casting mold; determining whether to lay metallic or non-metallic wire meshes and a number of layers of wire meshes to be laid between the ceramic granules, and then performing compaction; pouring molten metal matrix into a cavity of the mold; pressurizing and maintaining a pressure, based on material of the metal matrix, type of ceramic granules, and a desired product structure and specification; adjusting the pressure between 50 MPa and 200 MPa, and maintaining the pressure for a time between 30 s and 5 min; after maintaining the pressure, removing the metal matrix ceramic composite out from the mold.

Preferably, the heating temperature of the ceramic granules depends on the type of ceramics and matrix metals, and generally, the heating temperature of the ceramic granules can be in the range from 300° C. below to 200° C. above the melting point of the matrix metals. It is expected to approach the melting point of the matrix metals as much as possible, which facilitates the squeeze-casting molding.

For achieving the third object, an application of the metal matrix ceramic composite, wherein said metal matrix ceramic composite is used as a protective material for safes, automatic teller machines or vault gates.

Compared with the prior art, in this invention, the metal matrix ceramic composite, in which the ceramic granules having a diameter between 1 mm and 15 mm, a multilayer structure and a volume that is within a range of 10%-80% of the metal matrix ceramic composite, is formed by means of squeeze-casting, thus simplifying the process and reducing the cost. The array mode of ceramic granules of said composite in the matrix metal is similar to the array rule of space lattices in metals; therefore, said novel metal matrix ceramic composite may be defined as "Lattice Material". Molten metal is permeated into an array of ceramic granules under the action of pressure, which can achieve real three-dimensional restriction on ceramic granules after cooled and solidified. In addition, the ceramic granule layers have a multilayer array structure. The performances of the metal matrix ceramic composite, e.g. flame cutting resistance, mechanical cutting resistance, bullet-proof performance, anti-explosive performance and shock resistance, can be improved under the combined action of the aforesaid two factors. As ceramic granules are uniformly distributed in the matrix metal, the crack propagation in the matrix metal can be effectively prevented, further improving the resistance of said metal matrix ceramic composite against impact load. Meanwhile, as ceramics are good heat insulating materials and metals have excellent heat conductivity, the metal matrix ceramic composite made from the combination of the two materials can effectively ease the sharp rise of the temperature of materials during the flame cutting. If said metal matrix ceramic composite is used as a protective material for safes, automatic teller machines or vault gates, in the aspect of bullet-proof performance, the protective coefficient against armor-piercing bullets may reach 1.8 or above; and in the aspect of flame cutting resistance, metal matrix ceramic composites having a thickness of above 20 mm can resist against oxyacetylene cutting for more than 30 min without piercing. Therefore, said composite has broad application prospects in the protection of such important security facilities as safes, automatic teller machines and vault gates.

DETAILED DESCRIPTION OF THE PREFERRED EMBODIMENT

Figure 1:
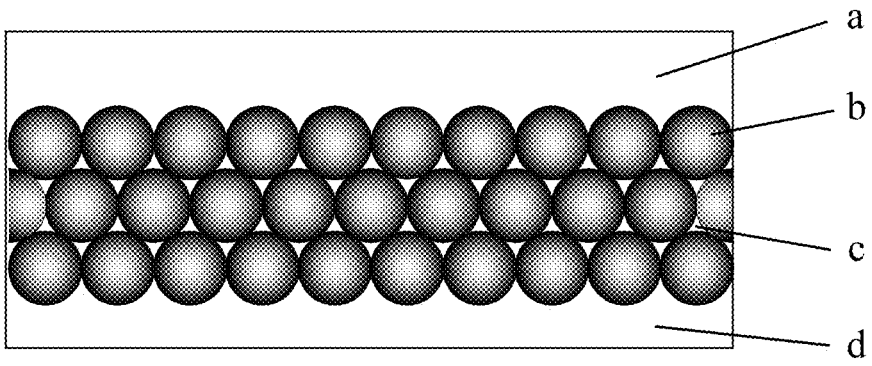
FIG. 1 is a view of the isodiametric random array structure of a metal matrix ceramic composite in accordance with the present invention without wire meshes. (a,d—the surface layer of the metal, b—the ceramic granules, c—the matrix metal)
Figure 2:
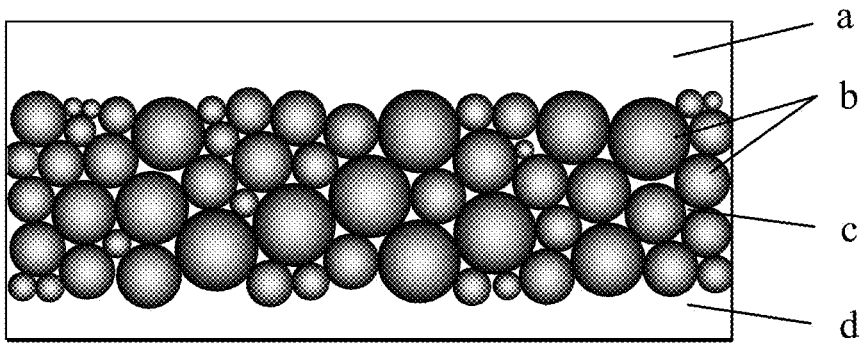
FIG. 2 is a view of the non-isodiametric random array structure of a metal matrix ceramic composite in accordance with the present invention without wire meshes. (a,d—the surface layer of the metal, b—the ceramic granules, c—the matrix metal)
Figure 3:
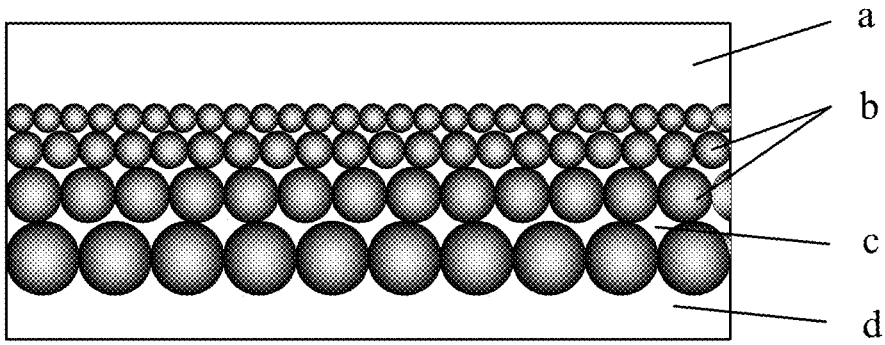
FIG. 3 is a view of the non-isodiametric gradient array structure of a metal matrix ceramic composite in accordance with the present invention without wire meshes. (a,d—the surface layer of the metal, b—the ceramic granules, c—the matrix metal)
Figure 4:
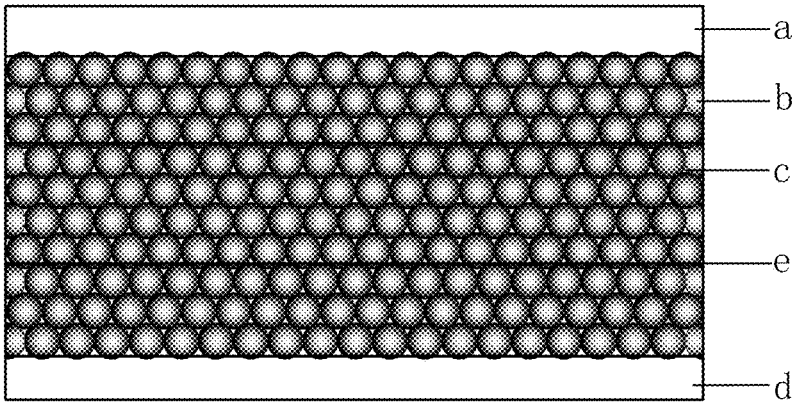
FIG. 4 is a view of the isodiametric random array structure of a metal matrix ceramic composite in accordance with the present invention with wire meshes. (a,d—the surface layer of the metal, b—the ceramic granules, c—the matrix metal, e—the wire meshes)
Figure 5:
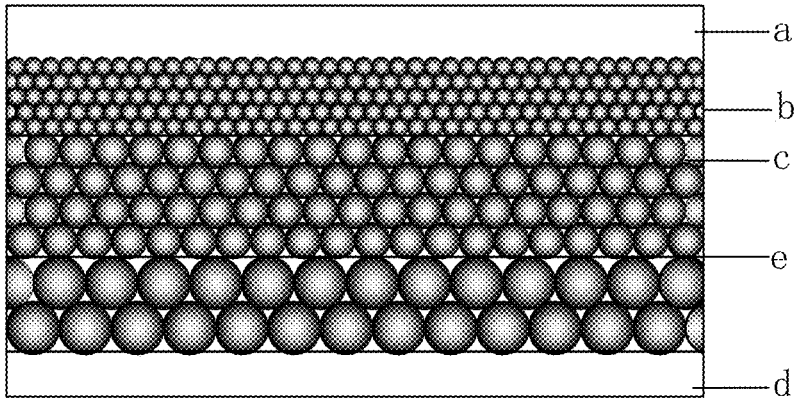
FIG. 5 is a view of a non-isodiametric gradient array structure of a metal matrix ceramic composite in accordance with the present invention with wire meshes. (a,d—the surface layer of the metal, b—the ceramic granules, c—the matrix metal, e—the wire meshes)
Figure 6:
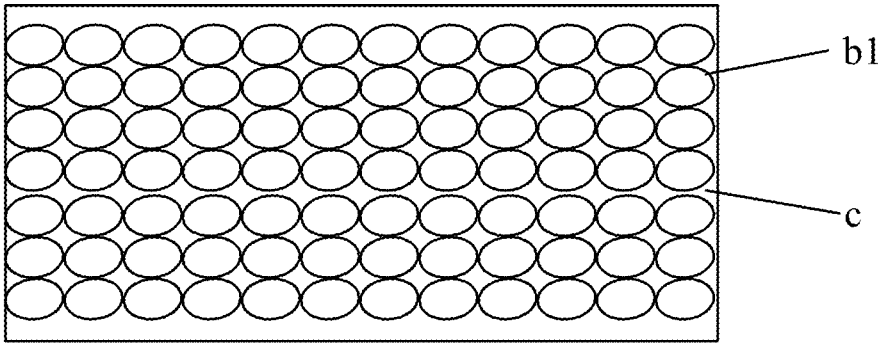
FIG. 6 is a horizontal sectional view of a metal matrix ceramic composite in accordance with the present invention without wire meshes and with uniformly-sized and orderly-arrayed ceramic ellipsoids. (b1—the ellipsoid ceramic granules, c—the ceramic granules)

To enable a further understanding of the innovative and technological content of the invention herein, refer to the detailed description of the invention and the accompanying drawings below:

Embodiment 1

This embodiment takes as an example the isodiametric array of the homogeneous ceramic balls without wire meshes.

Heating 4200 ml of Al2O3 ceramic balls having a diameter of 3 mm to 800° C. in the heating oven and then maintaining the heat for 2 h; pouring the pre-heated Al2O3 ceramic balls into a cavity of the mold with a dimension of 420 mm×420 mm; measuring 5.4 kg of molten aluminum alloy and pouring into the cavity of the mold; pressurizing 100 MPa and then maintaining the pressure for 2 min; after maintaining the pressure, removing an aluminum matrix ceramic composite out from the mold. The aluminum matrix ceramic composite, having a total thickness of 29 mm and a volume of 62% of the ceramic balls, can withstand oxyacetylene flame cutting for over 1 h.

Embodiment 2

This embodiment takes as an example the non-isodiametric random array of homogeneous ceramic balls without wire meshes.

Proportionally measuring a total amount of 5800 ml of Al2O3+ZrO2 ceramic balls with different diameters then mixing them up. For example, mixing up two types of the Al2O3+ZrO2 ceramic balls, which are 3 mm and 6 mm in diameter, according to a volume ratio of 1:1; after uniformly mixed, putting them into a heating oven to be heated to 800° C. and then maintaining this temperature for 2 h; pouring the pre-heated Al2O3+ZrO2 ceramic balls into a cavity of the mold with a dimension of 420 mm×420 mm; measuring 7.1 kg of molten aluminum alloy and pouring into the cavity of the mold; pressurizing 120 MPa and then maintaining the pressure for 2 min; after maintaining the pressure, removing an aluminum matrix ceramic composite out from the mold. The aluminum matrix ceramic composite, having a total thickness of 40 mm and a volume of 64% of the ceramic balls, can withstand oxyacetylene flame cutting for over 2 h.

Al2O3+ZrO2 ceramic balls are those in which 5%-25% of ZrO2 is added into Al2O3 for the purpose of improving the toughness during the preparation of the ceramic balls. In this invention, the amount of the added ZrO2 in the Al2O3+ZrO2 ceramic balls is 15% and the mass percentage of the Al2O3+ZrO2 ceramic balls is 100%.

Embodiment 3

This embodiment takes as an example the non-isodiametric gradient array of homogeneous ceramic balls without wire meshes.

Proportionally measuring a total amount of 9000 ml of SiN4 ceramic balls with different diameters. For example, choosing three types of the SiN4 ceramic balls, which are 3 mm, 6 mm and 9 mm in diameter, according to a volume ratio of 3:2:1; putting them respectively into a heating oven to be heated to 800° C. and then maintaining this temperature for 2 h; pouring the pre-heated SiN4 ceramic balls in batches into a cavity of the mold with a dimension of 420 mm×420 mm to be arrayed in a gradient way; measuring 13 kg of molten aluminum alloy and pouring into the cavity of the mold; pressurizing 140 MPa and then maintaining the pressure for 2 min; after maintaining the pressure, removing an aluminum matrix ceramic composite out from the mold. The aluminum matrix ceramic composite, having a total thickness of 60 mm and a volume of 56% of the ceramic balls, can withstand for oxyacetylene flame cutting for over 4 h.

Embodiment 4

This embodiment takes as an example the isodiametric array of heterogeneous ceramic balls without wire meshes.

Proportionally measuring a total amount of 4200 ml of Al2O3 ceramic balls, B4C ceramic balls and TiB2 ceramic balls in the same diameters of 3 mm according to a volume ratio of 1:1:1, then mixing them up; after uniformly mixed, putting them into a heating oven to be heated to 800° C. and then maintaining this temperature for 2 h; pouring the pre-heated Al2O3 ceramic balls, B4C ceramic balls and TiB2 ceramic balls into a cavity of the mold with a dimension of 420 mm×420 mm; measuring 5.4 kg of molten aluminum alloy and pouring into the cavity of the mold; pressurizing 100 MPa and then maintaining the pressure for 2 min; after maintaining the pressure, removing an aluminum matrix ceramic composite out from the mold. The aluminum matrix ceramic composite, having a total thickness of 29 mm and a volume of 62% of the ceramic balls, can withstand oxyacetylene flame cutting for over 1.5 h.

Embodiment 5

This embodiment takes as an example the non-isodiametric random array of heterogeneous ceramic balls without wire meshes.

Proportionally measuring a total amount of 5800 ml of several ceramic balls with different diameters then mixing them up. For example, mixing up two types of ceramic balls, which are Al2O3 ceramic balls in diameter of 3 mm and SiC ceramic balls in diameter of 6 mm, according to a volume ratio of 3:2:1; after uniformly mixed, putting them into a heating oven to be heated to 800° C. and then maintaining this temperature for 2 h; pouring the pre-heated Al2O3 ceramic balls and SiC ceramic balls into a cavity of the mold with a dimension of 420 mm×420 mm to be arrayed in a gradient way; measuring 13 kg of molten aluminum alloy and pouring into the cavity of the mold; pressurizing 120 MPa and then maintaining the pressure for 2 min; after maintaining the pressure, removing an aluminum matrix ceramic composite out from the mold. The aluminum matrix ceramic composite, having a total thickness of 40 mm and a volume of 64% of the ceramic balls, can withstand oxyacetylene flame cutting for over 3 h.

Embodiment 6

This embodiment takes as an example the non-isodiametric gradient array of heterogeneous ceramic balls without wire meshes.

Proportionally measuring a total amount of 9000 ml of several ceramic balls with different diameters. For example, choosing three types of the ceramic balls, which are Al2O3 ceramic balls in diameter of 3 mm, SiC ceramic balls in diameter of 6 mm and TiB ceramic balls in diameter of 9 mm, according to a volume ratio of 3:2:1; respectively putting them into a heating oven to be heated to 800° C. and then maintaining this temperature for 2 h; pouring the pre-heated Al203 ceramic balls, SiC ceramic balls and TiB ceramic balls into a cavity of the mold with a dimension of 420 mm×420 mm in batches to be arrayed in a gradient way; measuring 13 kg of molten aluminum alloy and pouring into the cavity of the mold; pressurizing 140 MPa and then maintaining the pressure for 2 min; after maintaining the pressure, removing an aluminum matrix ceramic composite out from the mold. The aluminum matrix ceramic composite, having a total thickness of 60 mm and a volume of 56% of the ceramic balls, can withstand oxyacetylene flame cutting for over 6 h.

Embodiment 7

This embodiment takes as an example the isodiametric array of the homogeneous ceramic balls with wire meshes.

Heating 4200 ml of ZrO2 ceramic balls having a diameter of 3 mm to 1000° C. in the heating oven and then maintaining the heat for 2 h; pouring the pre-heated ZrO2 ceramic balls into a cavity of the mold with a dimension of 420 mm×420 mm, meanwhile, wire meshes with a mesh dimension of 2 mm×2 mm are laid between the ceramic balls in accordance with the design requirements, so as to delaminate the ceramic balls, spaces between layers of the wire meshes can be adjusted according to total thickness of a layer of the ceramic granules, type of the ceramic granules, specification of the ceramic granules and distribution of the ceramic balls; measuring 15 kg of molten steel and pouring into the cavity of the mold; pressurizing 160 MPa and then maintaining the pressure for 3 min; after maintaining the pressure, removing an aluminum matrix ceramic composite out from the mold. The steel matrix ceramic composite, having a total thickness of 29 mm and a volume of 62% of the ceramic balls, can withstand oxyacetylene flame cutting for over 2 h.

Embodiment 8

This embodiment takes as an example the non-isodiametric gradient array of homogeneous ceramic balls with wire meshes.

Proportionally measuring a total amount of 9000 ml of TiB2 ceramic balls with different diameters. For example, choosing three type of the TiB2 ceramic balls, which are 3 mm, 6 mm and 9 mm in diameter, according to a volume ratio of 3:2:1; respectively putting them into a heating oven to be heated to 900° C. and then maintaining this temperature for 2 h; pouring the pre-heated SiN4 ceramic balls into a cavity of the mold with a dimension of 420 mm×420 mm in batches to be arrayed in a gradient way, meanwhile, wire meshes with a mesh dimension of 2 mm×2 mm are laid between the ceramic balls in accordance with the design requirements, so as to delaminate the ceramic balls, spaces between layers of the wire meshes can be adjusted according to total thickness of a layer of the ceramic granules, type of the ceramic granules, specification of the ceramic granules and distribution of the ceramic balls; measuring 41 kg of molten copper alloy and pouring into the cavity of the mold; pressurizing 140 MPa and then maintaining the pressure for 3 min; after maintaining the pressure, removing an aluminum matrix ceramic composite out from the mold. The copper matrix ceramic composite, having a total thickness of 60 mm and a volume of 56% of the ceramic balls, can withstand oxyacetylene flame cutting for over 4.5 h.

Embodiment 9

This embodiment takes as an example the isodiametric array of heterogeneous ceramic balls with wire meshes.

Proportionally measuring a total amount of 3500 ml of Al2O3 ceramic balls, B4C ceramic balls and TiB2 ceramic balls in the same diameters of 3 mm according to a volume ratio of 1:1:1; respectively putting them into a heating oven to be heated to 800° C. and then maintaining this temperature for 2 h; pouring the pre-heated Al2O3 ceramic balls, B4C ceramic balls and TiB2 ceramic balls into a cavity of the mold with a dimension of 420 mm×420 mm in batches; measuring 7 kg of molten aluminum alloy and pouring into the cavity of the mold; pressurizing 110 MPa and then maintaining the pressure for 2 min; after maintaining the pressure, removing an aluminum matrix ceramic composite out from the mold. The aluminum matrix ceramic composite, having a total thickness of 32 mm and a volume of 56% of the ceramic balls, can withstand oxyacetylene flame cutting for over 2 h.

Embodiment 10

This embodiment takes as an example the non-isodiametric gradient array of heterogeneous ceramic balls with wire meshes.

Proportionally measuring a total amount of 3500 ml of Al2O3 ceramic balls, B4C ceramic balls and TiB2 ceramic balls in the same diameters of 3 mm according to a volume ratio of 1:1:1; respectively putting them into a heating oven to be heated to 700° C. and then maintaining this temperature for 2 h; pouring the pre-heated Al2O3 ceramic balls, B4C ceramic balls and TiB2 ceramic balls into a cavity of the mold with a dimension of 420 mm×420 mm in batches; measuring 4.5 kg of molten magnesium alloy and pouring into the cavity of the mold; pressurizing 100 MPa and then maintaining the pressure for 1 min; after maintaining the pressure, removing an aluminum matrix ceramic composite out from the mold. The magnesium matrix ceramic composite, having a total thickness of 32 mm and a volume of 56% of the ceramic balls, can withstand oxyacetylene flame cutting for over 1 h.

Embodiment 11

This embodiment takes as an example the non-isodiametric gradient array of uniformly-sized and orderly-arrayed ceramic ellipsoids.

Heating 4200 ml of Al2O3 ellipsoid ceramic granules, each ellipsoid has a longer axis of 5 mm and a shorter axis of 3 mm, to 800° C. in the heating oven and then maintaining the heat for 2 h; pouring the pre-heated Al2O3 ceramic balls into a cavity of the mold with a dimension of 420 mm×420 mm to keep the longer axis of each ellipsoid or the shorter axis of each ellipsoid towards the same direction; measuring 6.5 kg of molten aluminum alloy and pouring into the cavity of the mold; pressurizing 100 MPa and then maintaining the pressure for 2 min; after maintaining the pressure, removing an aluminum matrix ceramic composite out from the mold. The aluminum matrix ceramic composite, having a total thickness of 30 mm and a volume of 56% of the ceramic balls, can withstand oxyacetylene flame cutting for over 1 h.

Embodiment 12

This embodiment takes as an example the application of metal matrix ceramic composite to safes.

Ceramic granules with different shapes and sizes and metal matrix ceramic composites with different volume percentages are selected as the protective materials for safe door panels and safe bodies according to the safety requirements of different types of safes. The metal matrix ceramic composites forming the safe bodies can be assembled by means of welding or mechanical connection. Usually, for the metal matrix ceramic composites in which the ceramic granules have a diameter between 1 mm and 15 mm, a multilayer array and a volume that is within a range of 10%-80% of the ceramic balls, the entire thickness of the composites is over 2 mm.

The safes refer to cabinets with large volume and boxes with small volume.

Embodiment 13

This embodiment takes as an example the application of the metal matrix ceramic composite in automatic teller machines.

Ceramic granules with different shapes and sizes and metal matrix ceramic composites with different volume percentages are selected as the protective materials for safe door panels and safe bodies, according to the safety requirements of different types of automatic teller machines. The metal matrix ceramic composites forming the safe bodies can be assembled by means of welding or mechanical connection. Usually, for the metal matrix ceramic composites in which the ceramic granules have a diameter between 1 mm and 15 mm, a multilayer array and a volume that is within a range of 10%-80% of the ceramic balls, the entire thickness of the composites is over 2 mm.

Embodiment 14

This embodiment takes as an example the application of the metal matrix ceramic composite in vault gates.

Ceramic granules with different shapes and sizes and metal matrix ceramic composites with different volume percentages are selected as the protective materials for vault gates, according to the safety requirements of different kinds of vault gates. The metal matrix ceramic composites forming the vault gates can be assembled by means of welding or mechanical connection. Usually, for the metal matrix ceramic composites in which the ceramic granules have a diameter between 1 mm and 15 mm, a multilayer array and a volume that is within a range of 10%-80% of the ceramic balls, the entire thickness of the composites is over 2 mm.

It can be known from the embodiment that, in this invention, the metal matrix ceramic composite with multilayer-arrayed ceramic granules is formed by means of the squeeze-casting, metal is permeated into an array of ceramic granules by means of the squeeze-casting, and the volume percentage of the ceramic granules may be adjusted within a range of 10%-80% of the metal matrix ceramic composite according to the usage requirements. This method has simple apparatuses, mature processes and low production cost and is extremely easy for mass production. Meanwhile, in such a structure, the matrix metal achieves real three-dimensional restriction on the ceramic granules, and the entire performance of the composite is high. It is proved by practices and tests that, the protective coefficient against armor-piercing bullets may reach 1.8 or above; in addition, this composite also has features of low density, resistance against ordinary mechanical cutting and flame cutting, and inhibition of crack propagation and the like. The metal matrix ceramic composites having a thickness of above 20 mm can resist against oxyacetylene cutting for more than 30 min without piercing. As may be used as the protective material for manufacturing Category A-C safes in accordance with Chinese national standards and U.S. standards, Level 0-10 safes, Level 8 ATM safes and Level 0-13 safes in accordance with European standards, this composite has broad application prospects in the protection of such important security facilities as safes, automatic teller machines and vault gates.

This embodiment only describes the ceramic granules as spheroids or ellipsoids. However, it may also be possible to use ceramic granules in other shapes, for example, polyhedral granules with more than eight faces, and the principles and effects are similar.

The invention claimed is:

1. A method for manufacturing a metal matrix ceramic composite comprising steps of:

heating ceramic granules and maintaining a heating temperature of the ceramic granules between 400° C. and 1400° C. according to type of matrix metals and ceramics used, wherein the heating temperature of the ceramic granules depends on type of ceramics and matrix metals, and the heating temperature of the ceramic granules is in a range of 300° C. below to 200° C. above a melting point of the matrix metals and the ceramic granules have a diameter between 3 mm and 9 mm;

transferring the heated ceramic granules in a multi-layer arrangement into a cavity of a squeeze-casting mold;

performing compaction;

pouring molten metal matrix into the cavity of the mold;

pressurizing and maintaining a pressure, based on material of the metal matrix, type of ceramic granules, and a desired product structure and specification;

adjusting the pressure between 50 MPa and 200 MPa based on material of the metal matrix, type of ceramic granules, and the desired product structure and specification;

maintaining the pressure for a time between 30 s and 5 min; and removing the metal matrix ceramic composite out from the mold;

wherein the metal matrix ceramic composite having a thickness of above 20 mm can resist against oxyacetylene cutting for more than 30 min without piercing.

2. The method of claim 1 further comprising the step of laying at least one wire mesh between the ceramic granules.

3. The method of claim 2, wherein the at least one wire mesh has a plurality of holes and each hole has a diameter that is smaller than a diameter of the ceramic granules.

4. The method of claim 1, wherein the matrix metal is selected from a group consists of steel, aluminum alloy, titanium alloy, zinc alloy, copper alloy, and magnesium alloy.

5. The method of claim 1, wherein the ceramic granules comprise one or more of following granules: $Al_2O_3$ ceramic granules, $ZrO_2$ ceramic granules, $B_4C$ ceramic granules, SiC ceramic granules, $Si_3N_4$ ceramic granules, $TiB_2$ ceramic granules, and $Al_2O_3$+$ZrO_2$ ceramic granules.

6. The method of claim 1, wherein the ceramic granules are spheroids with a sphericity of above 0.7 or ellipsoids.

7. The method of claim 1, wherein the ceramic granules have a multilayer structure and a volume that is within a range of 10%-80% of the metal matrix ceramic composite.

8. The method of claim 1, wherein the ceramic granules are homogeneous ceramic granules or heterogeneous ceramic granules, and the ceramic granules with different granular diameters may be distributed randomly, in a gradient way, or according to a distribution function.

9. The method of claim 1, wherein the matrix metal has a surface layer with a first thickness and a mixed layer of the ceramic granules and the matrix metal has a second thickness, the first thickness and the second thickness may be adjusted according to an entire thickness of the metal matrix ceramic composite and application requirements.

10. The method of claim 9, wherein a total thickness of the metal matrix ceramic composite may be three times larger than the diameter of the used ceramic granules.

* * * * *